US010156066B2

(12) United States Patent
Cormack

(10) Patent No.: US 10,156,066 B2
(45) Date of Patent: Dec. 18, 2018

(54) CORNER BEAD CLIP FOR ATTACHING TO STEEL MEMBERS

(71) Applicant: Park Derochie Inc., Edmonton (CA)

(72) Inventor: Cameron Lanning Cormack, Edmonton (CA)

(73) Assignee: Calaco Solutions Ltd., Edmonton, Alberta (CA)

( * ) Notice: Subject to any disclaimer, the term of this patent is extended or adjusted under 35 U.S.C. 154(b) by 0 days.

(21) Appl. No.: 15/592,891

(22) Filed: May 11, 2017

(65) Prior Publication Data

US 2018/0328022 A1 Nov. 15, 2018

(51) Int. Cl.

| | |
|---|---|
| ***E04F 13/073*** | (2006.01) |
| ***E04B 1/94*** | (2006.01) |
| ***E04B 1/41*** | (2006.01) |
| ***E04F 13/06*** | (2006.01) |
| *E04C 3/04* | (2006.01) |

(52) U.S. Cl.

CPC ..... *E04B 1/944* (2013.01); *E04B 1/40* (2013.01); *E04F 13/06* (2013.01); *E04F 13/0733* (2013.01); *E04C 3/04* (2013.01); *E04F 2013/063* (2013.01); *Y10T 24/344* (2015.01)

(58) Field of Classification Search

CPC ... E04F 13/06; E04F 13/0814; E04F 13/0733; E04F 2013/063; Y10T 24/344; E04C 3/04; E04B 1/40; E04B 1/944

USPC ..... 24/295; 52/834

See application file for complete search history.

(56) References Cited

U.S. PATENT DOCUMENTS

| | | | |
|---|---|---|---|
| 640,409 | A | 1/1900 | Parker |
| 640,858 | A | 1/1900 | Bartholomew |
| 656,274 | A | 8/1900 | Streeter |
| 662,228 | A | 11/1900 | Escher |
| 682,489 | A | 9/1901 | Parker |
| 780,344 | A | 1/1905 | Hurlbert |
| 863,440 | A | 8/1907 | Prescott |
| 902,632 | A | 11/1908 | White |
| 914,000 | A | 3/1909 | Wilson |
| 943,590 | A | 12/1909 | Diescher |
| 956,364 | A | 4/1910 | King |
| 956,439 | A | 4/1910 | Shear |
| 1,019,462 | A | 3/1912 | Hannon |
| 1,106,730 | A | 8/1914 | Sanderson |
| 1,145,198 | A | 7/1915 | Knapp |
| 1,196,753 | A | 9/1916 | Alms |
| 1,257,980 | A | 3/1918 | Clark |
| 1,339,360 | A | 5/1920 | Leonard |
| 1,379,862 | A | 5/1921 | Goldsmith |

(Continued)

FOREIGN PATENT DOCUMENTS

| | | | |
|---|---|---|---|
| CA | 1077911 A1 | 5/1980 | |
| DE | 3338037 A1 * | 5/1985 | ..... E04B 1/944 |

(Continued)

*Primary Examiner* — Robert Canfield

(74) *Attorney, Agent, or Firm* — Dentons US LLP; Brian R. McGinley; Roman Tsibulevskiy

(57) ABSTRACT

An improved corner bead clip is provided for use in attaching corner beads to structural steel members where fireproofing material can be applied to the corner beads. The clip includes jaws that can attach to the steel members with a friction fit, and a body attached to the jaws where the body has notches for receiving longitudinal wires of the corner beads to hold them in place.

15 Claims, 7 Drawing Sheets

(56) References Cited

U.S. PATENT DOCUMENTS

| | | | | |
|---|---|---|---|---|
| 1,430,508 | A | 9/1922 | Johnson | |
| 1,453,973 | A | 5/1923 | Coryell | |
| 1,490,701 | A | 4/1924 | Knapp | |
| 1,585,036 | A | 5/1926 | Jones | |
| 1,674,210 | A | 6/1928 | Dison et al. | |
| 1,728,461 | A | 9/1929 | Wolcott | |
| 1,787,804 | A * | 1/1931 | Thurman | E04F 13/045 140/106 |
| 1,825,914 | A | 10/1931 | Midcap | |
| 1,858,836 | A | 5/1932 | Martell | |
| 2,127,806 | A | 8/1938 | Burt | |
| 2,142,165 | A | 1/1939 | Young et al. | |
| 2,213,603 | A | 9/1940 | Young et al. | |
| 2,370,052 | A | 2/1945 | Lindelow | |
| 2,465,756 | A | 3/1949 | Schepis | |
| 2,702,932 | A | 3/1955 | Woodson | |
| 2,921,464 | A | 1/1960 | Olsen | |
| 2,945,329 | A | 7/1960 | Schneller | |
| 3,276,800 | A | 10/1966 | Loudon et al. | |
| 3,298,646 | A | 1/1967 | Van Buren, Jr. | |
| 3,412,512 | A | 11/1968 | Hollister | |
| 3,516,213 | A | 6/1970 | Sauer | |
| 3,559,356 | A | 2/1971 | Koral | |
| 3,748,815 | A | 7/1973 | Parker | |
| 3,765,138 | A | 10/1973 | Bentle | |
| 3,800,365 | A | 4/1974 | Bruggert | |
| 3,897,669 | A | 8/1975 | Uydess | |
| 3,908,327 | A | 9/1975 | Quigg | |
| 3,962,840 | A | 6/1976 | Nelsson | |
| 3,974,619 | A | 8/1976 | Turner | |
| 3,989,398 | A | 11/1976 | Wendt | |
| 4,043,092 | A | 8/1977 | Paul et al. | |
| 4,077,105 | A | 3/1978 | Boyce, Jr. et al. | |
| 4,324,079 | A | 4/1982 | Pearson | |
| 4,484,427 | A | 11/1984 | Crites | |
| 4,584,811 | A | 4/1986 | Balinski | |
| 5,130,184 | A * | 7/1992 | Ellis | C04B 28/30 106/18.12 |
| 5,157,887 | A | 10/1992 | Watterworth, III | |
| 5,357,682 | A | 10/1994 | Henderson, Jr. | |
| 5,482,395 | A | 1/1996 | Gasparini | |
| 5,531,051 | A | 7/1996 | Chenier, Jr. et al. | |
| 5,625,986 | A | 5/1997 | Mansfield et al. | |
| 5,644,883 | A | 7/1997 | Menchetti | |
| 5,685,116 | A | 11/1997 | Bradshaw et al. | |
| 5,788,403 | A | 8/1998 | Dison et al. | |
| 6,058,859 | A | 5/2000 | Colosimo, Jr. | |
| 6,067,691 | A | 5/2000 | Feltman | |
| 6,367,220 | B1 | 4/2002 | Krause et al. | |
| 6,385,935 | B2 | 5/2002 | Lippy | |
| 6,637,172 | B2 | 10/2003 | Bousquet | |
| 8,132,383 | B1 | 3/2012 | Herrmann et al. | |
| 8,250,822 | B2 | 8/2012 | O'Connor | |
| 8,555,593 | B2 | 10/2013 | Ramos | |
| 1,686,278 | A1 | 9/2015 | Miller | |
| 9,140,005 | B2 | 9/2015 | Miller | |
| 2003/0051431 | A1 | 3/2003 | Bousquet | |
| 2005/0039414 | A1 | 2/2005 | Miller et al. | |
| 2006/0272268 | A1 | 12/2006 | Miller et al. | |
| 2007/0119106 | A1 | 5/2007 | Sacks et al. | |
| 2007/0144091 | A1 | 6/2007 | Brindle | |
| 2007/0193187 | A1 | 8/2007 | O'Connor | |
| 2013/0167475 | A1 | 7/2013 | Ramos | |
| 2014/0352243 | A1 | 12/2014 | Miller | |
| 2016/0374201 | A1 * | 12/2016 | Wang | H01R 12/728 |

FOREIGN PATENT DOCUMENTS

| | | | | |
|---|---|---|---|---|
| DE | 102012003522 | A1 * | 8/2013 | F16B 3/005 |
| EP | 1061191 | A2 | 12/2000 | |
| EP | 1084312 | A1 | 3/2001 | |
| EP | 1907649 | B1 | 3/2013 | |
| FR | 2657380 | A1 * | 7/1991 | E04B 1/944 |
| GB | 956060 | A * | 4/1964 | E04B 1/944 |
| WO | 2000031352 | A1 | 6/2000 | |
| WO | 2012105858 | A1 | 8/2012 | |

* cited by examiner

CORNER BEAD CLIP FOR ATTACHING TO STEEL MEMBERS

The present application claims a benefit of priority to Canadian Patent Application 2,964,871 filed 18 Apr. 2017, which is herein incorporated by reference in its entirety.

TECHNICAL FIELD

The present disclosure relates generally to a method and apparatus for attaching a corner bead to structural steel members used for the purpose of fireproofing and, more particularly, to an improved clip used to secure the corner bead to the structural steel member while providing precise positioning and efficiency in labor of corner bead application, and to methods of use in the fireproofing of structural steel members.

BACKGROUND

Structural steel members lose their load bearing capacity quickly when exposed to high heat. As a result, insurance companies, building codes, and owners require fire protection on structural steel. Passive type fireproofing is employed to prevent premature collapse and eliminate extensive property damage.

Typical passive fireproofing entails the application of a material to the surface of the steel that will insulate the steel from the effects of fire. Historically, endothermic materials have been used to a large extent and are still in use today, such as gypsum, concrete and other cementitious products. Fireproofing material retards both temperature acceleration and flame spread, thus providing the necessary time for fire fighters to either gain control of a fire or to achieve safe shutdown of key areas in a structure or plant.

Fireproofing material is applied to various thicknesses. However, to achieve maximum protection in industrial and commercial settings, appropriate material thickness can only be achieved by way of mechanical reinforcement such as lath and corner beads. When applying a fireproofing material, it is generally desirable to provide a lath on the surface of the steel. The lath provides reinforcement for the fireproofing material and also attaches the fireproofing material to the steel surface.

There are a number of different metal laths being used for fireproofing. One common type is expanded metal lath. Another group of metal laths is wire fabric laths. Within this group, there are woven wire laths and welded wire laths which may be referred to as wire mesh.

At the corners, a corner bead is normally provided since it is either required by building codes, or by the builder or the owner to obtain a desired architectural result. The most commonly used corner beads are bent into a V-shape of approximately 70 degrees to 80 degrees. The general type of corner bead used in fireproofing is made from a grid of wires welded together, bent into a V-shape with a continuous longitudinal wire at the nose to act as the guide to form the corner.

The prior art welded wire corner beads generally consist of a series of sinusoidal wires and a series of longitudinal wires resistance welded together at their intersections and may also have a plastic cover around the nose wire.

When the corner bead is installed correctly, it becomes the depth gage or screed that will regulate the depth of the fireproofing material at the corners. In the art of installing corner bead for fireproofing structural steel, prior approaches conventionally comprise a v-shaped plastic nose corner bead having adjustable legs (flanges). The longitudinal base wires of the v-shaped corner bead are attached with a tie wire either onto a metal lath or onto a wire mesh, and further attached to the steel member to be fireproofed. It is also common to employ steel pins that have been embedded into the steel member, to anchor the corner bead and the lath.

The vertex of a V-shaped corner bead is represented by the nose wire, which may be covered in plastic. To establish the correct fireproofing thickness, one must shrink or expand the distance between the legs (flanges) of the corner bead defined by the vertex to establish the correct height of the vertex. Using this technique, the alignment of the corner bead with the adjacent surface is difficult and great skill and substantial time is required to install the corner bead for fireproofing structural steel.

Accordingly, the need exists for an improved corner bead installation method to avoid inaccuracy in gauging the thickness of the fireproofing material and to allow easy and efficient installation, and apparatus to achieve the said method. The clip of the present invention provides positional accuracy and greatly reduces labor for installing the corner bead to the steel member.

SUMMARY

In some embodiments, a simple and efficient means of attaching corner bead to structural steel in an accurate and quick manner is provided, wherein the corner beads are used in the application of fireproofing material around structural steel members, and wherein the fireproofing material has uniform thickness around the structural steel.

In some embodiments, an improved technique is provided for application of accurate thickness of fireproofing material along two surfaces under any construction condition for fireproofing the structural steel members.

In some embodiments, a corner bead clip can be made from metal and can further comprise a spring-loaded clamping mechanism that can be used to attach itself to the structural steel. The body of the metal clip can comprise attachment points that the corner bead can utilize for quick and easy fixation. In some embodiments, the attachment points can comprise notches disposed in the body section of the clip. These notches can be a fixed position from the clamping portion of the clip. The clamping portion of the clip can engage the steel member on its flange. The opening or "jaw" of the clip is such that it can provide firm attachment to the steel flange. The design of the jaw area can also provide minimal movement of the flange and clip relative to each other in the jaw area, once the clip is properly installed. Since the clip can attach firmly to the flange, then the position of the notches of the clip can be consistent in relation to the flange.

In some embodiments, prior art corner beads can be secured to the improved clip. The prior art corner beads can comprise longitudinal wires that can create a position-consistent attachment framework that the notches disposed on the improved clip can engage. Spring force within the legs of the corner bead can hold the longitudinal wires firmly engaged into the notches. Since the corner bead can be known and dimensionally-consistent, as well as the retaining notches on the improved clip, and given that the engagement between the improved clip and the steel member can be firm and precise, then the improved clip can provide the location of the corner bead at a precise and known distance from the flange of the steel member.

In some embodiments, a properly sized clip can be applied with a hammer by a person in a matter of seconds. Additionally, prior art corner beads can also be applied by a person without any tools in a matter of seconds. The improved clip provided herein can provide a fast, sturdy and accurate method for applying corner bead to steel members.

Furthermore, the manufacturing cost of the improved corner bead attachment clip can be relatively inexpensive, as the part is small and can be made from various metal stamping and forming processes like progressive stamping and forming. Rolls of spring steel can be straightened and fed into a press machine with progressive stamping and forming capabilities to blank and bend the improved clip to the desired shape. A heat treatment to the untreated clip can also provide desired spring characteristics.

Broadly stated, in some embodiments, a clip can be provided for attaching a corner bead thereto, the corner bead comprising a pair of spaced-apart longitudinal structural wires, the clip comprising: a jaw comprising a pair of spaced-apart arms defining a mouth having a longitudinal axis, the jaw configured for attaching to a structural steel member; and a planar body member operatively coupled to the jaw, the planar body member comprising at least one pair of notches configured for receiving the pair of spaced-apart longitudinal structural wires, wherein the corner bead becomes attached to the clip substantially perpendicular to the longitudinal axis.

Broadly stated, in some embodiments, a system can be provided for attaching a corner bead to a structural steel member, the corner bead comprising a pair of spaced-apart longitudinal structural wires, the system comprising two or more clips configured to attach in a spaced-apart configuration to a flange disposed on the structural steel member, each clip comprising: a jaw comprising a pair of spaced-apart arms defining a mouth having a longitudinal axis, the jaw configured for attaching to a structural steel member; and a planar body member operatively coupled to the jaw, the planar body member comprising at least one pair of notches configured for receiving the pair of spaced-apart longitudinal structural wires, wherein the corner bead becomes attached to the clip substantially perpendicular to the longitudinal axis.

Broadly stated, in some embodiments, one or both of the arms can comprise a lip.

Broadly stated, in some embodiments, the planar body member can be substantially parallel to the longitudinal axis.

Broadly stated, in some embodiments, the planar body member can further comprise two or more pairs of notches configured for receiving the pair of spaced-apart longitudinal structural wires, wherein the corner bead becomes attached to the clip at one of two or more positions relative to the clip.

Broadly stated, in some embodiments, the planar body member can further comprise at least one opening extending therethrough, the at least one opening configured for receiving cementitious fireproofing material passing therethrough and interlocking therewith upon the cementitious fireproofing material curing.

Broadly stated, in some embodiments, a method can be provided for fireproofing a structural steel member, the method comprising the steps of: applying lath to exterior surfaces of the structural steel member; installing at least two clips in a spaced-apart configuration along a first flange of the structural steel member, wherein each clip comprises: a jaw comprising a pair of spaced-apart arms defining a mouth having a longitudinal axis, the jaw configured for attaching to the flange of the structural steel member, and a planar body member operatively coupled to the jaw, the planar body member comprising at least one pair of notches configured for receiving a pair of spaced-apart longitudinal structural wires of a first corner bead, wherein the first corner bead becomes attached to the at least two clips substantially perpendicular to the longitudinal axis; inserting the pair of spaced-apart longitudinal structural wires into the at least one pair notches of each of the at least two clips, thereby attaching the corner bead to the clips; and applying cementitious fireproofing material to the lath and the corner bead.

Broadly stated, in some embodiments, the method can further comprise the steps of: installing at least two more of the at least two clips on a second flange of the structural steel member; installing a second corner bead to the at least two more of the at least two clips; and applying the cementitious fireproofing material to the second corner bead and to the lath disposed between the first corner bead and the second bead.

Broadly stated, in some embodiments, the method can further comprise the step of screeding the cementitious fireproofing material disposed between the first corner bead and the second corner bead.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
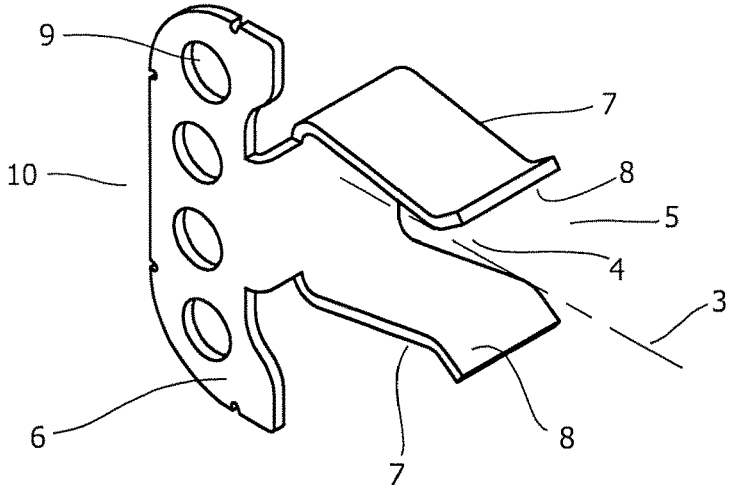
FIG. 1 is an isometric view depicting one embodiment of an improved corner bead clip.
Figure 2:
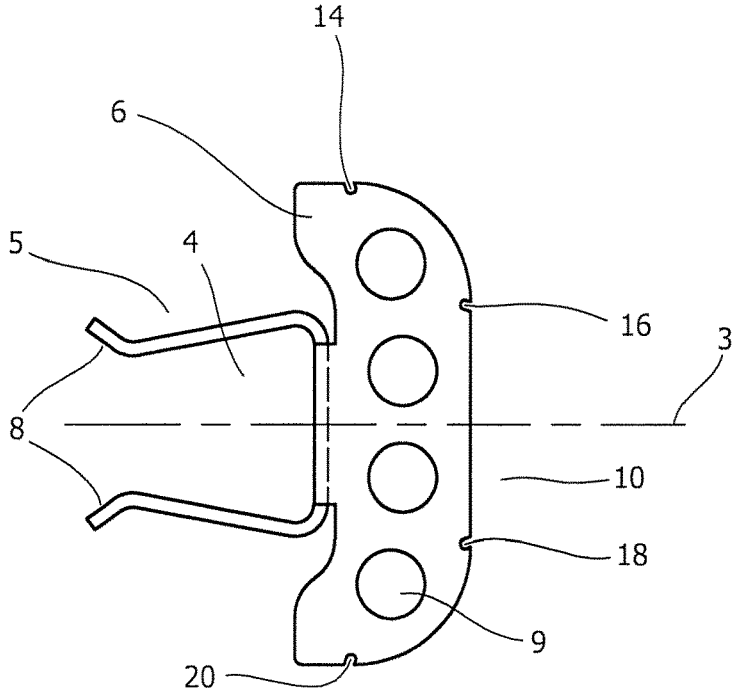
FIG. 2 is a side elevation depicting the corner bead clip of FIG. 1.

Referring to FIG. 1 and FIG. 2, one embodiment of improved corner bead clip 10 is shown. In some embodiments, clip 10 can be made from any number of materials such as steel, plastic, fiberglass and aluminum, to name but a few, in addition to any other suitable materials as well known to those in the art. In some embodiments, clip 10 can be comprised of spring steel that has been heat treated to give clip 10 the necessary and required spring characteristics to enable it to be attached to a structural steel member.

Figure 8:
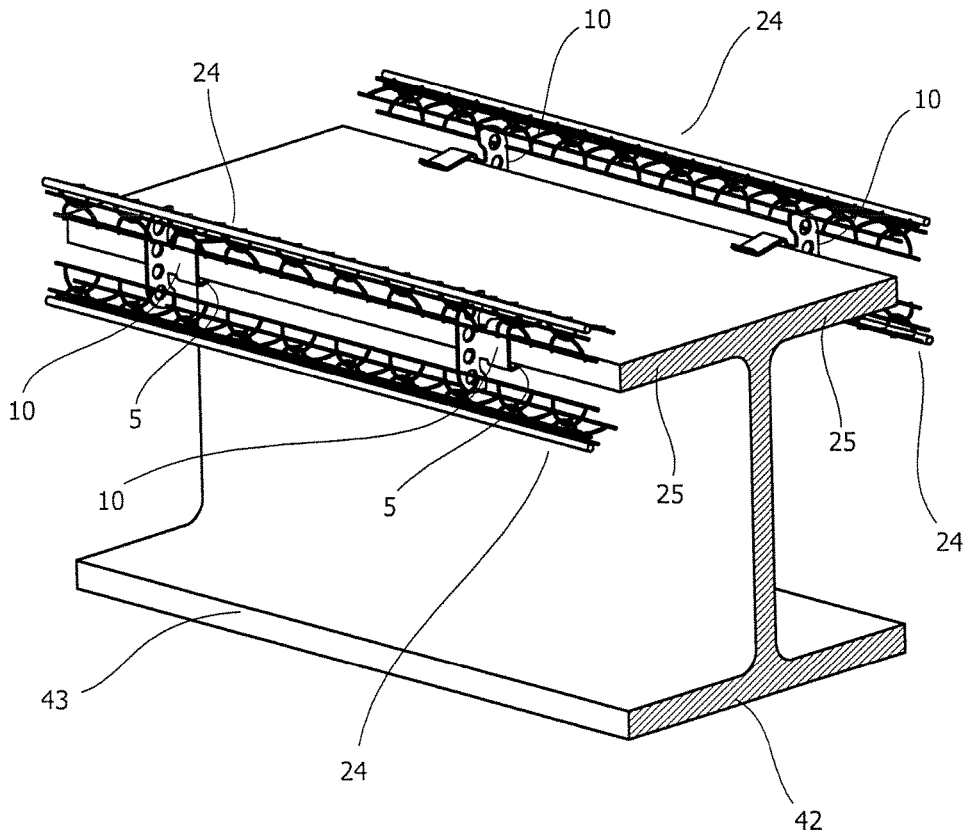
FIG. 8 is a perspective view of the corner bead clip of FIG. 1 attached to a structural steel member, with the corner bead of FIG. 3 attached to the corner bead clip.

In some embodiments, clip 10 can comprise two spaced-apart arms 7 defining jaw 5, and forming mouth 4 in which the steel member can be inserted to. Each of arms 7 can comprise lip 8 turned up at the end thereof that can provide a ramp-like effect while inserting clip 10 over flange 25 of steel member 42 as shown in FIG. 8, as an example. The opening of jaw 5 can be smaller than the thickness of flange 25 of steel member 42, to which it can be installed. This structural arrangement of arms 7 and lips 8 can provide sufficient clamping force, via the spring characteristics of arms 7, to attach clip 10 to steel member 42. In some embodiments, arms 7 can be configured such that mouth 4 can be aligned with longitudinal axis 3, which can represent the direction clip 10 is moved along when being installed on a flange of a structural steel member.

Figure 3:
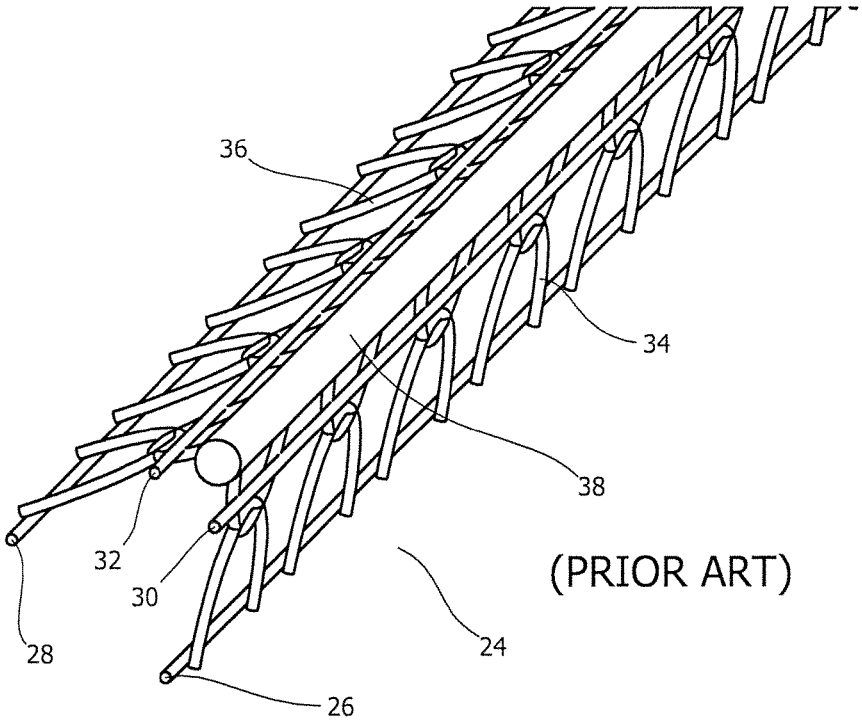
FIG. 3 is a perspective view of a prior art corner bead.
Figure 4:
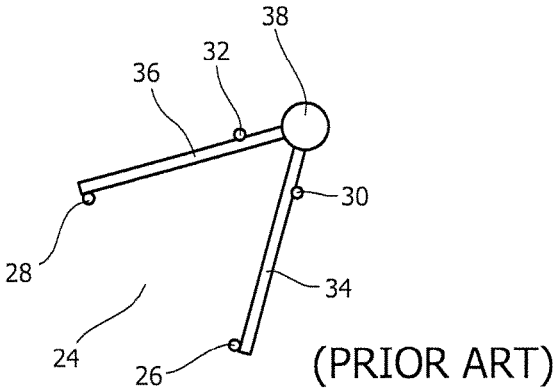
FIG. 4 is an end elevation view depicting the corner bead of FIG. 3.

FIG. 3 and FIG. 4 show a prior art corner bead 24 that can be used with clip 10. Leg 34 and leg 36 of corner bead 24 can also comprise longitudinal wire 26 and longitudinal wire 28, respectively. Additional longitudinal wires can also be disposed within legs 34 and 36 of corner bead 24, such as longitudinal wire 30 and longitudinal wire 32. In some embodiments, wires 30 and 32 are not utilized by notches 16 or 18 in the embodiment of clip 10, as shown in FIGS. 1 and 2. In some embodiments, nose 38 of corner bead 24 can also comprise a longitudinal wire, and can be further covered with a cylindrical plastic cover (not shown), as well known by those skilled in the art.

As shown in FIG. 2, body 6 of clip 10 can comprise notches 14, 16, 18 and 20 that can act as attachment points on corner bead 24 for longitudinal wires 26 and 28. In some embodiments, clip 10 can comprise one or more holes 9 disposed through body 6 as a means for reducing thermal conductivity and for providing cavities for the fireproofing material to attach and interlock with body 6. In some embodiments, body 6 can comprise a planar member that is operatively coupled to jaw 5, wherein body 6 is substantially parallel to longitudinal axis 3. In some embodiments, clip 10 can be formed from a single piece of stamped steel in processes well known to those skilled in the art, wherein arms 7 can be bent into the piece of stamped steel to form jaw 5 and lips 8, and wherein jaw 5 can then be bent relative to body 6 whereby body 6 can be substantially parallel to longitudinal axis 3.

As shown in FIGS. 3 and 4, corner bead 24 can comprise has legs 34 and 36, wherein each leg can comprise at least one longitudinal wire, shown as reference numerals 26 and 28, that can engage notches 14, 16, 18 and 20. The size of longitudinal wires 26 and 28 can be selected such that it can fit inside of notches 14, 16, 18 and 20. In some embodiments, notches 14, 16, 18 and 20 can be grouped in pairs. For example, notch 14 and notch 16 can be one pair, and notch 18 and notch 20 can be another pair. In some embodiments, one pair of notches is needed for one corner bead 24.

Figure 5:
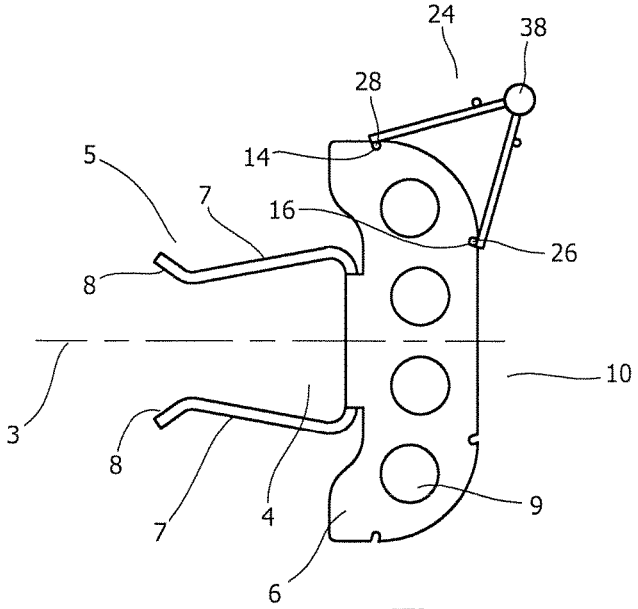
FIG. 5 is a side elevation view depicting the corner bead of FIG. 3 attached to the corner bead clip of FIG. 1.

Referring to FIG. 5, corner bead 24 can be connected to clip 10 by way of longitudinal wire 28 engaging or being inserted into notch 14, and longitudinal wire 26 engaged or inserted into notch 16, whereby corner bead 24 can be substantially perpendicular to longitudinal axis 3. A spring force acting thru legs 34 and 36 of corner bead 24 to urge the legs towards one another can keep longitudinal wires 26 and 28 engaged into the respective notches 16 and 14 of clip 10. In order to dislodge longitudinal wires 26 and 28 from notches 16 and 14, a force greater than the inherent spring force of legs 34 and 36 must be applied in an opposing direction. This opposing force must move longitudinal wires 26 and 28 out of notches 16 and 14 via the notch path that is mostly perpendicular in direction to the plane defined by legs 34 and 36, and mostly opposite in direction to the spring force of legs 34 and 36. FIG. 5 depicts a single corner bead 24 attached to clip 10 but in some embodiments, two corner beads 24 can be attached to clip 10.

Figure 6:
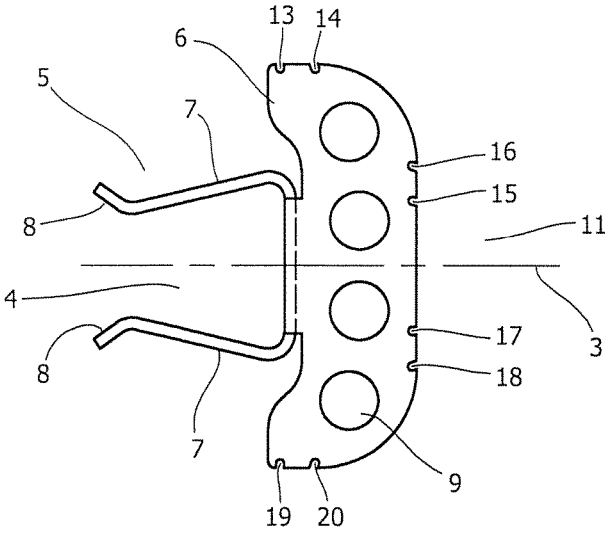
FIG. 6 is a side elevation view depicting an alternate embodiment of the corner bead clip of FIG. 1.

FIG. 6 depicts an alternate embodiment to clip 10 as shown in FIGS. 1 and 2. In this embodiment, clip 11 can comprise additional notches 13, 15, 17 and 19 that clip 10 does not comprise. In some embodiments, these additional notches 13, 15, 17 and 19 can provide additional and alternate attachment points for corner bead 24.

Figure 7:
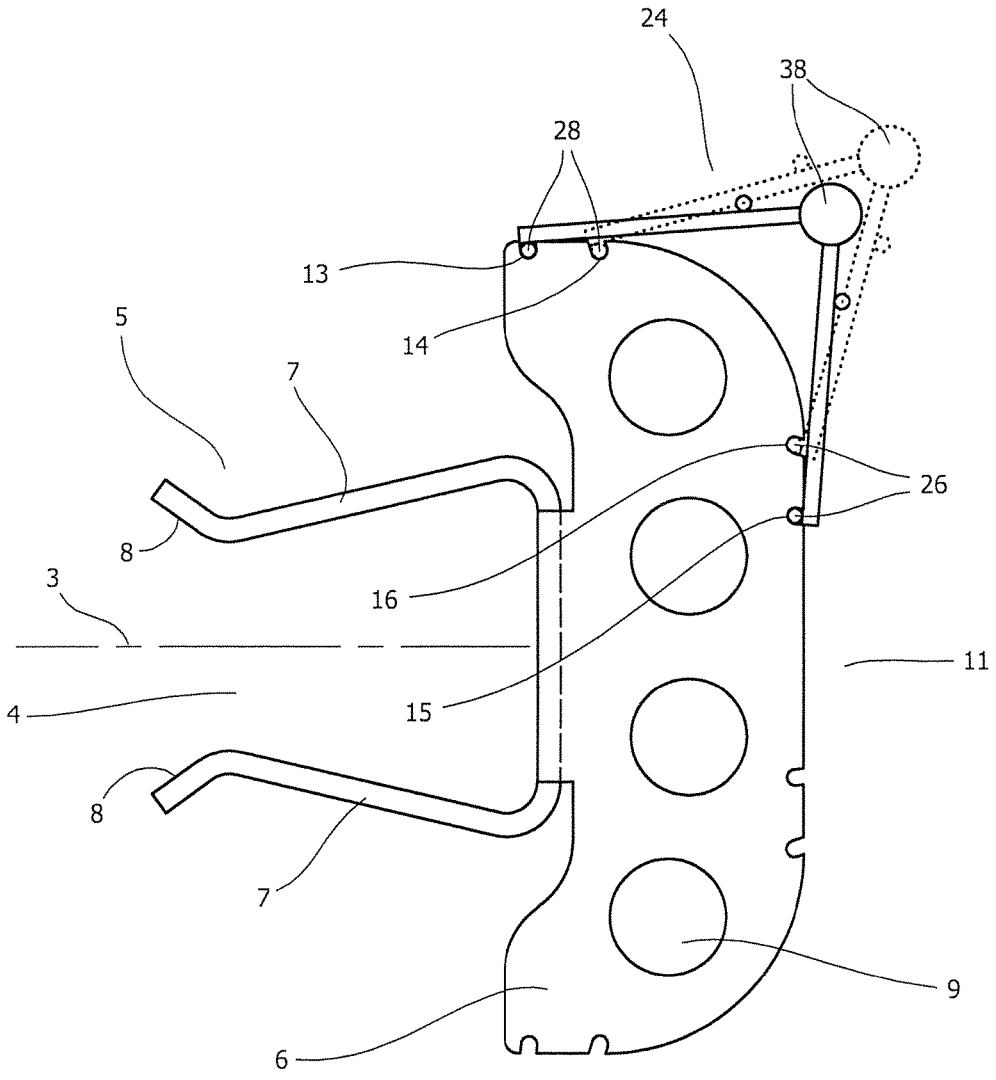
FIG. 7 is an end elevation view depicting the corner bead of FIG. 3 attached to the corner bead clip of FIG. 6.

FIG. 7 provides a visual representation of the multiple attachment point arrangement that can be provided by clip 11. In some embodiments, longitudinal wire 28 can engage either of notch 13 and notch 14, and longitudinal wire 26 can engage either of notch 15 and notch 16. In FIG. 7, the solid line drawing of corner bead 24 shows the position of nose 38 when longitudinal wire 28 is engaged into notch 13 and longitudinal wire 26 is engaged into notch 15, whereas the dotted line drawing of corner bead 24 shows the position of nose 38 when longitudinal wire 28 is engaged into notch 14 and longitudinal wire 26 is engaged into notch 16. It can be clearly seen in FIG. 7 by the position of nose 38 of corner bead 24 that the engagement of different notches 13, 14, 15 and 16 can produce different positions for nose 38 relative to clip 11.

Referring to FIG. 8, structural steel member 42 (in this instance, an "I-beam") is shown with clips 10 and corner beads 24 installed on upper flanges 25. It can be seen that jaws 5 of clips 10 can be inserted over flange 25 of structural steel member 42. In some embodiments, a plurality of clips 10 can be installed on flange 25 to secure a single piece of corner bead 24 to steel member 42. The spacing between clips 10 can be variable, and can be determined based on the amount of rigidity and stability required for corner bead 24, as well known to those skilled in the art. Since longitudinal wires 26 and 28 can be continuous, then there can be an infinite ability to position clip 10 along the length of corner bead 24.

Figure 9:
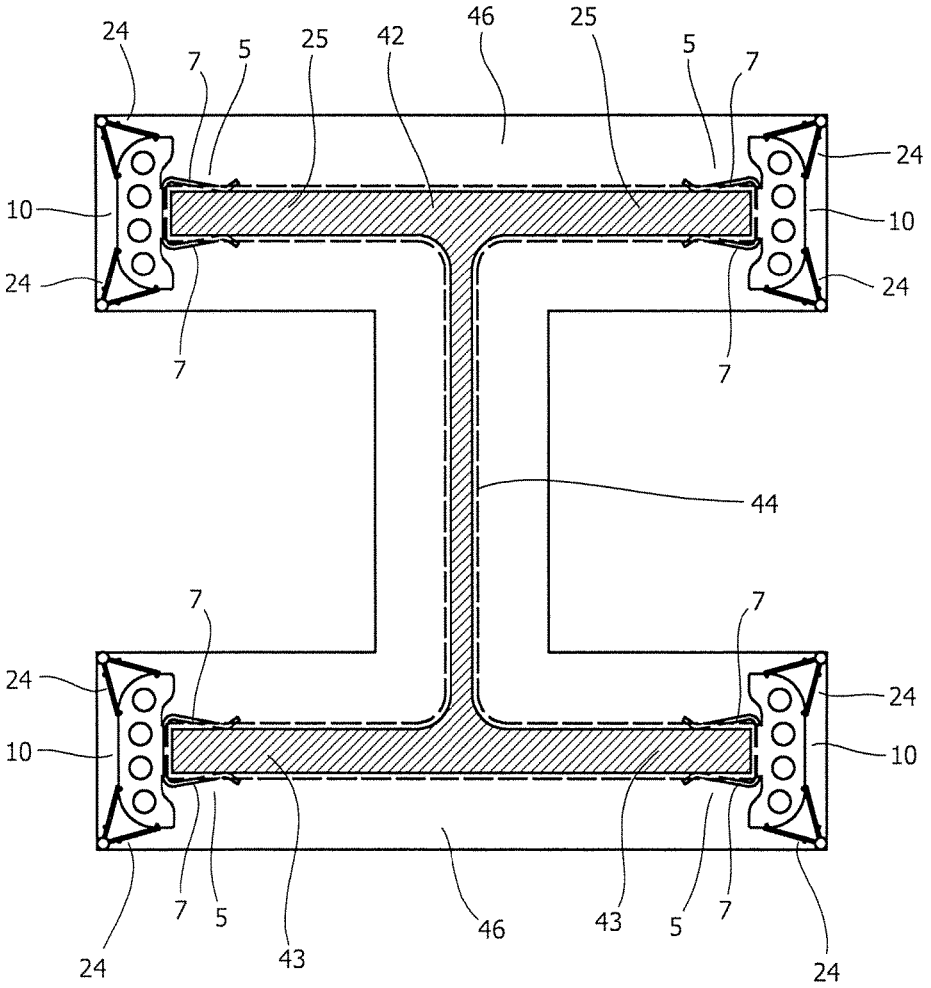
FIG. 9 is an end cross-section view depicting one embodiment of the structural steel member of FIG. 8 encased in cementitious fireproofing material.

In some embodiments, two methods of enveloping a structural steel member with fireproofing material can be utilized. As shown in FIG. 9, cementitious fireproofing material 46 can surround and follow the contours of structural steel member 42, tracing structural steel member 42 in all its dimensions. It can also be seen that jaws 5 of clips 10 can clamp to lath 44 disposed around steel member 42, as well as to flanges 25 and 43, with both arms 7 of each clip 10.

Figure 10:
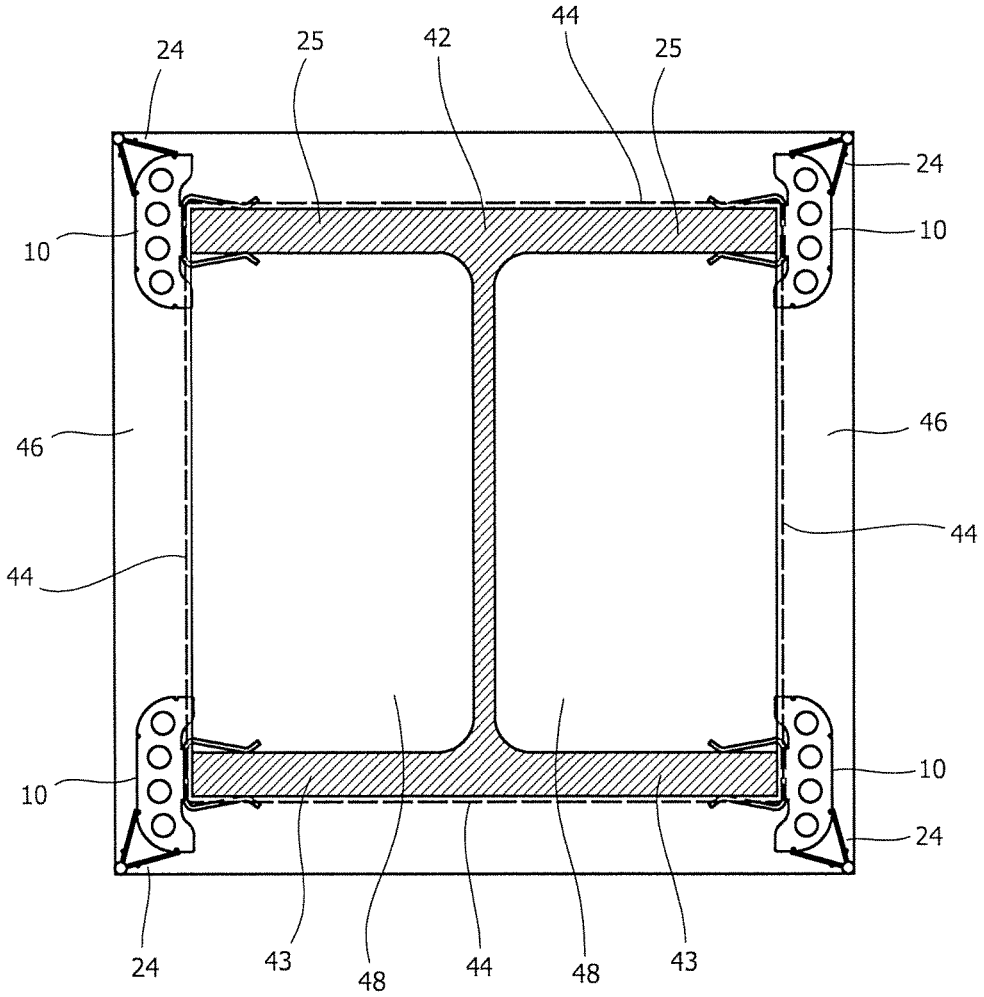
FIG. 10 is an end cross-section view depicting an alternate embodiment of the structural steel member of FIG. 8 encased in cementitious fireproofing material.

In some embodiments, as shown in FIG. 10, cementitious fireproofing material 46 can surrounds the dimensions of structural steel member 42 in a hollow-box manner, which can be assembled by placing sheets of lath 44 around steel member 42, as shown in FIG. 10, thus creating empty void areas 48 with structural steel member 42 after cementitious fireproofing material 46 has been applied to lath 44. In some embodiments, clips 10 can clamp to flanges 25 and 43 with, or without, or in combination of the presence of lath 44 disposed against the surface of steel member 42 in a similar fashion as described above and shown in FIG. 9.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. A clip for attaching a corner bead thereto, the corner bead comprising a pair of spaced-apart longitudinal structural wires, the clip comprising:

a) a jaw comprising a pair of spaced-apart arms defining a mouth having a longitudinal axis, the jaw configured for attaching to a structural steel member; and b) a planar body member operatively coupled to the jaw, the planar body member comprising at least one pair of notches configured for receiving the pair of spaced-apart longitudinal structural wires, wherein the corner bead becomes attached to the clip substantially perpendicular to the longitudinal axis, wherein the planar body member further comprises two or more pairs of notches configured for receiving the pair of spaced-apart longitudinal structural wires, wherein the corner bead becomes attached to the clip at one of two or more positions relative to the clip.

2. The clip as set forth in claim 1, wherein one or both of the arms comprises a lip.

3. The clip as set forth in claim 1, wherein the planar body member is substantially parallel to the longitudinal axis.

4. The clip as set forth in claim 1, wherein the planar body member further comprises at least one opening extending therethrough, the at least one opening configured for receiving cementitious fireproofing material passing therethrough and interlocking therewith upon the cementitious fireproofing material curing.

5. A system for attaching a corner bead to a structural steel member, the corner bead comprising a pair of spaced-apart longitudinal structural wires, the system comprising two or more clips configured to attach in a spaced-apart configuration to a flange disposed on the structural steel member, each of the clips comprising:

a) a jaw comprising a pair of spaced-apart arms defining a mouth having a longitudinal axis, the jaw configured for attaching to a structural steel member; and b) a planar body member operatively coupled to the jaw, the planar body member comprising at least one pair of notches configured for receiving the pair of spaced-apart longitudinal structural wires, wherein the corner bead becomes attached to the clip substantially perpendicular to the longitudinal axis, wherein the planar body member further comprises two or more pairs of notches configured for receiving the pair of spaced-apart longitudinal structural wires, wherein the corner bead becomes attached to the clip at one of two or more positions relative to the clip.

6. The system as set forth in claim 5, wherein one or both of the arms comprises a lip.

7. The system as set forth in claim 5, wherein the planar body member is substantially parallel to the longitudinal axis.

8. The system as set forth in claim 5, wherein the planar body member further comprises at least one opening extending therethrough, the at least one opening configured for receiving cementitious fireproofing material passing therethrough and interlocking therewith upon the cementitious fireproofing material curing.

9. A method for fireproofing a structural steel member, the method comprising:

a) applying lath to exterior surfaces of the structural steel member;

b) installing at least two clips in a spaced-apart configuration along a first flange of the structural steel member, wherein each of the clips comprises:

i) a jaw comprising a pair of spaced-apart arms defining a mouth having a longitudinal axis, the jaw configured for attaching to the first flange of the structural steel member, and ii) a planar body member operatively coupled to the jaw, the planar body member comprising at least one pair of notches configured for receiving a pair of spaced-apart longitudinal structural wires of a first corner bead, wherein the first corner bead becomes attached to one of the at least two clips substantially perpendicular to the longitudinal axis;

c) inserting the pair of spaced-apart longitudinal structural wires into the at least one pair notches of the one of the at least two clips, thereby attaching the first corner bead to the one of the clips; and d) applying cementitious fireproofing material to the lath and the first corner bead.

10. The method as set forth in claim 9, further comprising:

installing at least two more of the at least two clips on a second flange of the structural steel member;

installing a second corner bead to one of the at least two more of the at least two clips; and applying the cementitious fireproofing material to the second corner bead and to the lath disposed between the first corner bead and the second corner bead.

11. The method as set forth in claim 10, further comprising screeding the cementitious fireproofing material disposed between the first corner bead and the second corner bead.

12. The method as set forth in claim 9, wherein one or both of the arms comprises a lip.

13. The method as set forth in claim 9, wherein the planar body member is substantially parallel to the longitudinal axis.

14. The method as set forth in claim 9, wherein the planar body member further comprises two or more pairs of notches configured for receiving the pair of spaced-apart longitudinal structural wires, wherein the first corner bead becomes attached to the one clip at one of two or more positions relative to one the clip.

15. The method as set forth in claim 9, wherein the planar body member further comprises at least one opening extending therethrough, the at least one opening configured for receiving the cementitious fireproofing material passing therethrough and interlocking therewith upon the cementitious fireproofing material curing.

* * * * *